US007220101B2

(12) United States Patent
Chen et al.

(10) Patent No.: US 7,220,101 B2
(45) Date of Patent: May 22, 2007

(54) CENTRIFUGAL FAN AND FAN FRAME THEREOF

(75) Inventors: Te-Fu Chen, Taoyuan Hsien (TW); Tsung-Yu Lei, Taoyuan Hsien (TW); Kuo-Cheng Lin, Taoyuan Hsien (TW); Wen-Shi Huang, Taoyuan Hsien (TW)

(73) Assignee: Delta Electronics, Inc., Taoyuan (TW)

( * ) Notice: Subject to any disclaimer, the term of this patent is extended or adjusted under 35 U.S.C. 154(b) by 193 days.

(21) Appl. No.: 10/889,008

(22) Filed: Jul. 13, 2004

(65) Prior Publication Data

US 2005/0207886 A1 Sep. 22, 2005

(30) Foreign Application Priority Data

Mar. 18, 2004 (TW) ..... 93107229 A

(51) Int. Cl.
*F04D 29/44* (2006.01)

(52) U.S. Cl. ..... 415/204; 415/207; 415/224

(58) Field of Classification Search ..... 415/53.1, 415/207, 204, 224, 206
See application file for complete search history.

(56) References Cited

U.S. PATENT DOCUMENTS 3,090,543 A * 5/1963 Busquet ..... 416/183
3,385,511 A * 5/1968 Wentling ..... 415/53.1
3,407,995 A * 10/1968 Kinsworthy ..... 415/204
2004/0115049 A1* 6/2004 Chien ..... 415/206

FOREIGN PATENT DOCUMENTS

JP 60145497 A * 7/1985

* cited by examiner

*Primary Examiner*—Richard A. Edgar
(74) *Attorney, Agent, or Firm*—Birch, Stewart, Kolasch & Birch, LLP

(57) ABSTRACT

A centrifugal fan, comprising a frame and a first guide portion. The frame comprises a bottom portion and a curved wall connected thereto. The curved wall comprises an airflow inlet. The first guide portion disposed along the curved wall at the bottom portion comprises a beginning area, a middle area, and an ending area. The middle area connects the beginning and the ending areas, and the beginning area extends from the airflow inlet. The beginning area has a width less than that of the ending area, and the beginning area has a height greater than that of the ending area.

10 Claims, 7 Drawing Sheets

CENTRIFUGAL FAN AND FAN FRAME THEREOF

This Nonprovisional application claims priority under 35 U.S.C. § 119(a) on Patent Application No(s). 093107229 filed in Taiwan, Republic of China on Mar. 18, 2004, the entire contents of which are hereby incorporated by reference.

BACKGROUND OF THE INVENTION

The invention relates to a centrifugal fan and, in particular, to a centrifugal fun with a fan frame that can enhance fan performance substantially. Electronic devices generally produce heat during operation, and thus the demand for effective heat-dissipation devices has increased. Therefore, a heat-dissipating device or a centrifugal fan must offer optimal perforniance to dissipate the excess heat. As shown in FIG. 1, a conventional centrifugal fan 1 includes a fan frame F and an impeller I. FIG. 1 is a perspective view of a combination of the fan frame F and the impeller I. FIG. 2 is a perspective view of the fan frame F. The fan frame F includes a frame F' and a sleeve S. The impeller I is disposed F' of the fan frame F comprises a curved wall W, a bottom portion B, and a first guide portion G.

Higher air pressure increases the amount of airflow and speed, and vice versa. The fan frame structure F is one of the main factors affecting the air pressure level. In the conventional design, when the fan operates, airflow is produced and flows along the curved wall between the guide portion G and the impeller I. However, since the guide portion G has a flat elevation as shown in FIG. 3, the airflow surrounding the impeller I is disturbed, thereby producing cyclonic airflow and reducing air pressure. Thus, the total performance of the fan is reduced accordingly. Specifically, turbulent flow is produced at the inlet, and a certain level of flow resistance is generated. Thus, the guide portion & with a flat elevation is unable to efficiently guide the airflow, but adversely reduces the heat dissipation performance of the fan.

Since the above method does not satisfy performance demands, there is still a need for a fan structure offering enhanced performance without increasing the overall size of the fan that can minimize the airflow disturbance produced along a flow path between the fan frame and the impeller to maximize the airflow and air pressure.

SUMMARY

An embodiment of the invention, therefore, provides a centrifugal fan that eliminates the shortcomings described above and increases heat dissipation performance.

The invention provides a centrifugal fan comprising a frame and a first guide portion. The frame comprises a bottom portion and a curved wall connected thereto. The curved wall comprises an airflow inlet. The first guide portion disposed along the curved wall at the bottom portion comprises a beginning area, a middle area, and an ending area. The middle area connects the beginning and the ending areas, and the beginning area extends from the airflow inlet. The beginning area has a width less than that of the ending area, and the beginning area has a height greater than that of the ending area.

The frame further comprises a top portion. The beginning area has a height of less than 30% of a distance measured from the bottom portion to the top portion.

At least the beginning area, the middle area, or the ending area comprises a sloped surface.

One of the beginning area, the middle area, or the ending area comprises a flat surface parallel to the bottom portion.

In an embodiment of the invention, the bottom portion and the first guide portion are integrally formed.

The frame further comprises a top portion comprising a second guide portion, disposed corresponding to the first guide portion. A distance between the first guide portion and the second guide portion is at least 70% of a distance from the bottom portion to the top portion.

The first guide portion and the second guide portion are symmetrically formed.

Furthermore, the top portion and the second guide portion are integrally formed.

An embodiment of the invention further provides a centrifugal fan comprising an impeller and a fan frame. The fan frame comprises a top portion, a bottom portion, and a curved wall. The curved wall is connected to the top portion and the bottom portion, surrounding the impeller. The curved wall comprises an airflow inlet. The top portion and the bottom portion each comprises at least one guide portion, disposed along the curved wall such that a flow path is formed within the guide portion, the curved wall, and the impeller. Additionally, the width of the flow path increases radially from the airflow inlet along the impeller, and the height of the flow path increases axially from the airflow inlet along an axis of the impeller.

The height of the flow path at the airflow inlet is at least 70% of a distance between the top portion and the bottom portion.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION

First Embodiment

Figure 1:
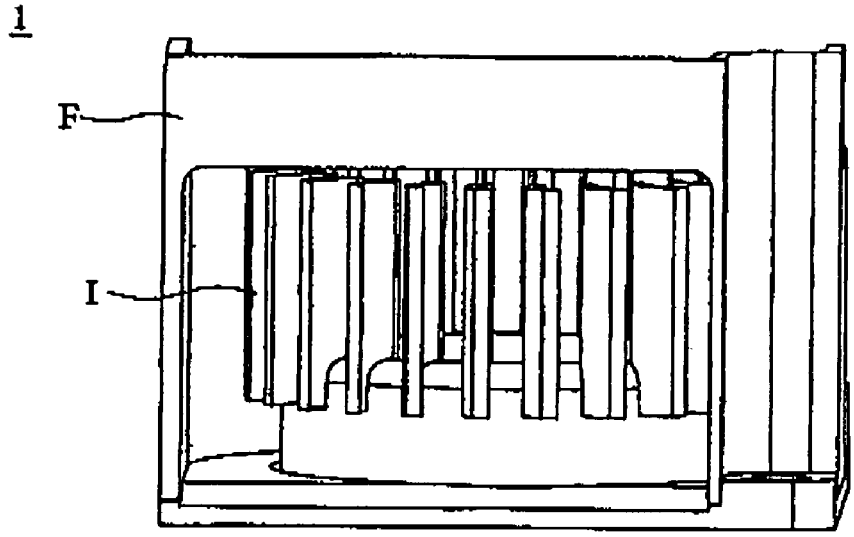
FIG. 1 is a schematic diagram of a conventional centrifugal fan.
Figure 2:
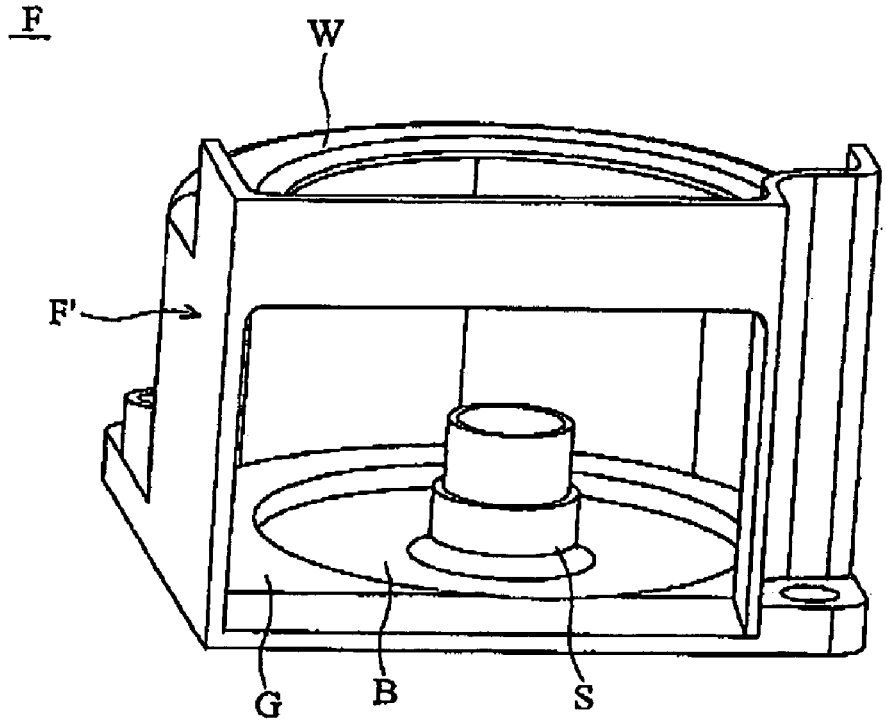
FIG. 2 is a schematic perspective diagram of a fun frame of the conventional centrifugal fan.
Figure 3:
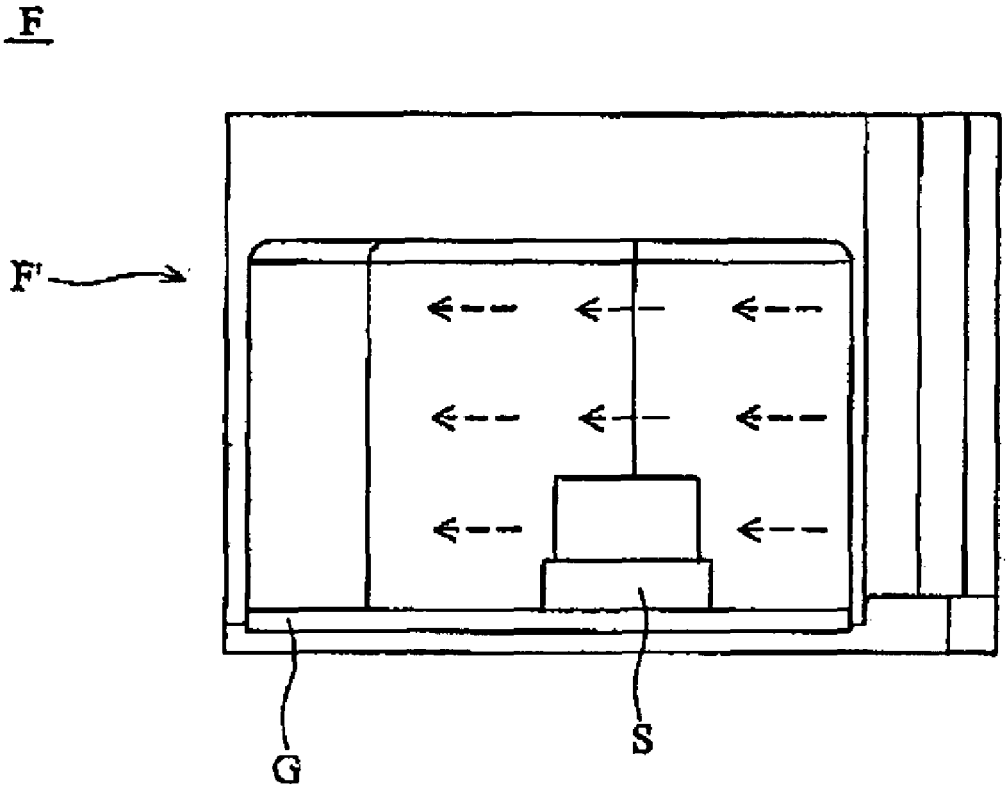
FIG. 3 is a side view of the frame of FIG. 2.
Figure 4:
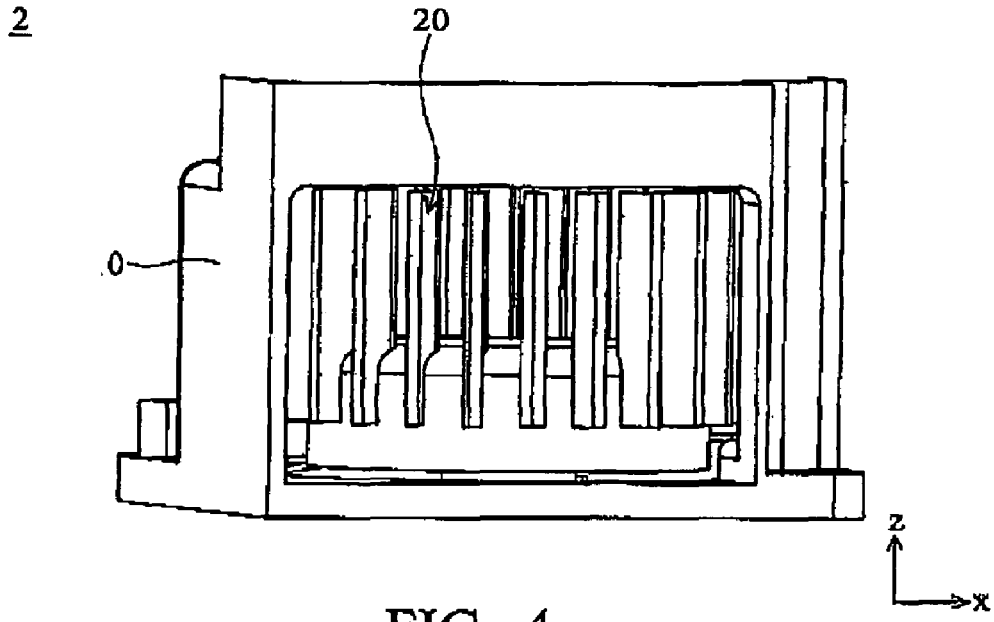
FIG. 4 is a schematic view of a centrifugal fan of a first embodiment of the invention.

Please refer to FIG. 4. FIG. 4 is a schematic view of a centrifugal fan 2 of a first embodiment of the invention. The centrifugal fan 2 comprises a fan frame 10 and an impeller 20.

Figure 5:
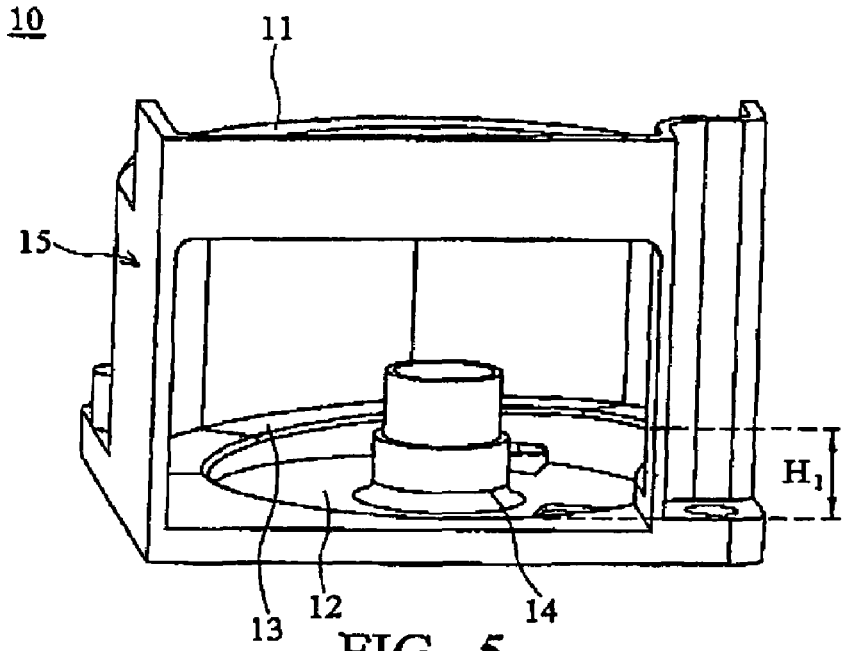
FIG. 5 is a schematic view of a centrifugal fan frame of a first embodiment of the invention.

Please refer to FIG. 5. FIG. 5 is a schematic view of the fan frame 10. The fan frame 10 comprises an outer frame 15, a curved wall 11, a bottom portion 12, a first guide portion 13, and a sleeve 14. The impeller 20 is disposed within the outer frame 15 through the sleeve 14. The curved wall 11 encircling the impeller 20 is connected to the bottom portion 12.

Figure 6:
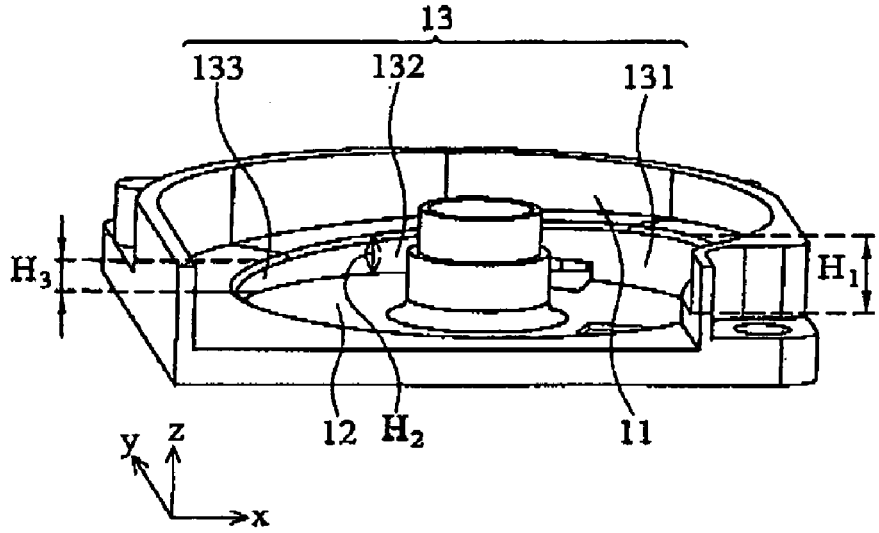
FIG. 6 is a local enlarged view of the centrifugal fan frame of FIG. 5.

Please refer to FIG. 6. FIG. 6 is a local enlarged view of the centrifugal fan frame 10 of FIG. 5. The first guide portion 13 encircling the sleeve 14 is also disposed on the bottom portion 12. The bottom portion 12 and the first guide portion 13 are integrally formed.

Figure 7:
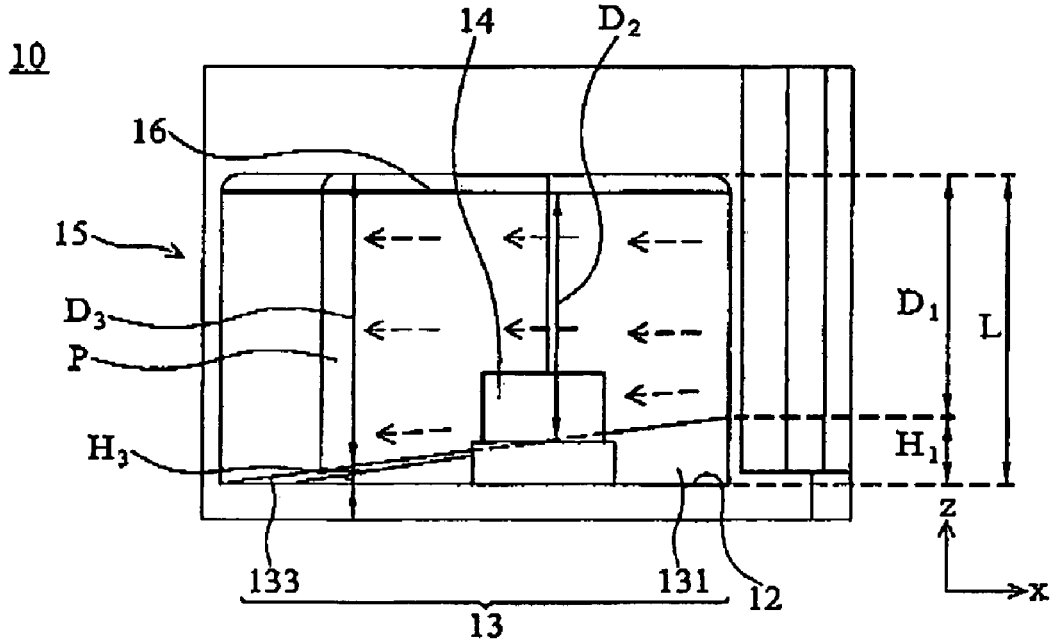
FIG. 7 is a side view of the centrifugal fan frame according to the first embodiment of the invention.

A flow path P is formed within the first guide portion 13, the curved wall 11, and the impeller 20. Air flows in the flow path P according to arrows shown in FIGS. 7 and 8. The flow path P increases its width and height along the airflow direction such that the air can flow smoothly, increasing total performance of the fan. In this embodiment, the variation in the size of the flow path P is achieved by varying the structure of the first guide portion 13. Details of the variation will be described in the following.

The first guide portion 13 can be divided into a beginning area 131, a middle area 132, and an ending area 133. The beginning area 131 is located at an airflow inlet of the fan frame 10. The middle area 132 connects the beginning area 131 and the ending area 133. The beginning area 131, the middle area 132, and the ending area 133 each has a sloped surface or a flat surface such that the height of the first guide portion 13 decreases from the beginning area 131, the middle area 132, and the ending area 133, respectively.

Since the beginning area 131, the middle area 132, and the ending area 133 each has a different sloped angle, and each has a different height, $H_1$, $H_2$, and $H_3$, respectively. In this embodiment, the beginning area 131 has the largest height $H_1$, and the ending area 133 has the smallest height $H_3$.

Figure 8:
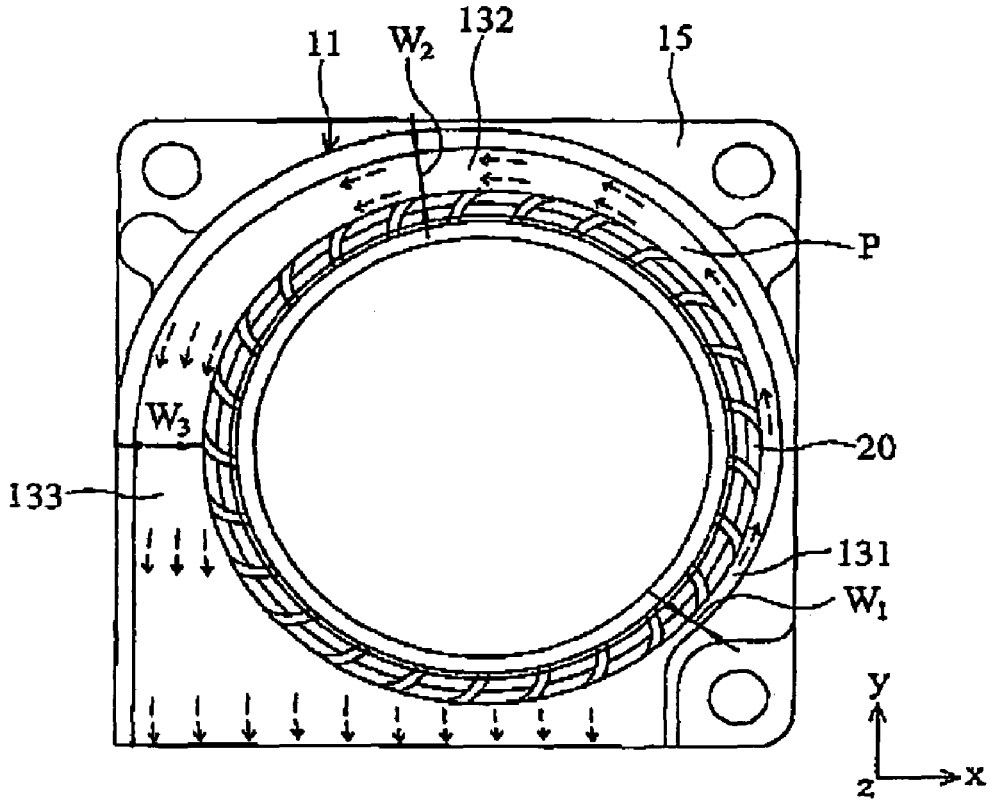
FIG. 8 is a top view of the centrifugal fan frame according to the first embodiment of the invention.

The distance L between the top portion 16 and the bottom portion 12 of the fan frame 10 is defined as the maximum height of flow path P, and the height H1 is about 20–30% of the maximum height L of flow path P. According to the flow path, the depth of flow path P at the airflow inlet is about 70% of the distance between the top portion 16 and the bottom portion 12 of the fan frame 10. As shown in FIG. 8, the width of the flow path P is narrower at the beginning area 131 and wider at the ending area 133.

In detail, when the width of the flow path P at the beginning area 131 is referred to as w1, the width of the flow path P at the middle area 132 is referred to as w2, and the width of the flow path P at the ending area 133 is referred to as w3, w1 is the minimum width, and the w3 is the maximun width. The width of the flow path P gradually increases from airflow inlet such that air pressure and airflow volume are augmented for smooth airflow. Thus, the fan according to the above embodiment produces less turbulence, increasing overall performance.

Second Embodiment

Figure 9:
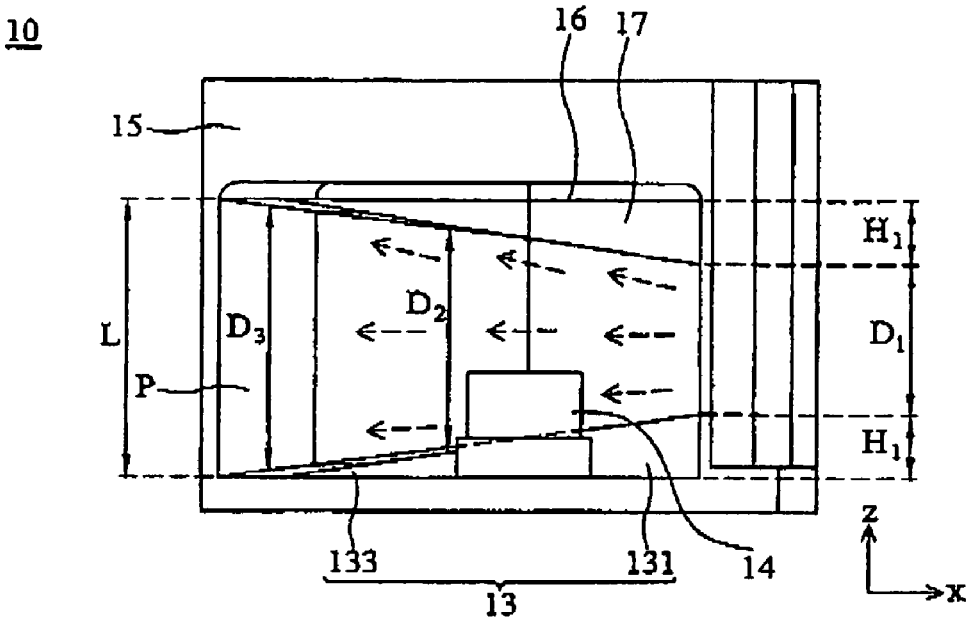
FIG. 9 is a side view of the centrifugal fan frame according to a second embodiment of the invention.

Please refer to FIG. 9. FIG. 9 is a side view of the centrifugal fan frame 10 according to a second embodiment of the invention. The elements common to the first embodiment are omitted. As shown in FIG. 9, the top portion 16 further comprises a second guide portion 17, disposed corresponding to the first guide portion 13. The distance D between the first guide portion 13 and the second guide portion 17 near the airflow inlet is at least 70% of the distance L between the top portion 16 and the bottom portion 12. Since the second guide portion 17 and the first guide portion 13 are formed symmetrical to a plane parallel to the horizon, the shapes of the second guide portion 17 and the first guide portion 13 are substantially identical.

The depth of flow path P varies from D1, D2, and D3 from the right-most side in FIG. 9 toward −x direction. Thus, D1 is less than D2, and D3. D3 is substantially equal to the distance L between the top portion 16 and the bottom portion 12. As mentioned, the width of the flow path P or the first guide portion 13 is gradually increased from the beginning area 131 toward a radial direction of the impeller 20, as indicated by widths w1, w2, and w3. Thus, the width and height of the flow path P are both gradually increased, providing better performance and smoother flow and reducing turbulence.

Figure 10:
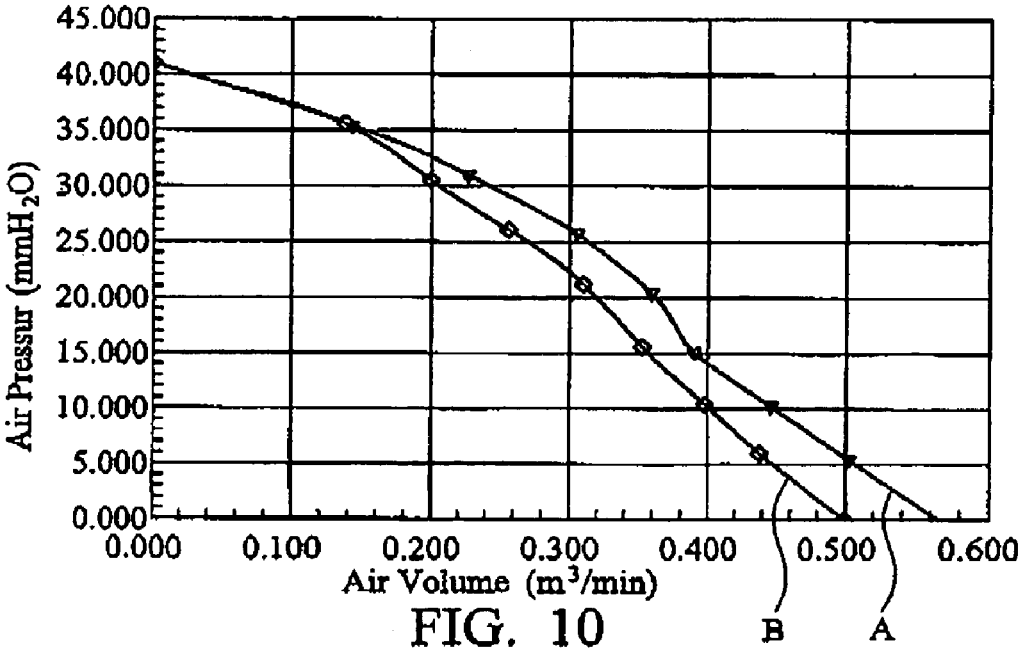
FIG. 10 shows a relationship between air pressure and flow volume of a centrifugal fan frame according to the second embodiment of the invention.

Furthermore, FIG. 10 shows a relationship between air pressure and airflow volume of a centrifugal fan frame according to the second embodiment of the invention. The data on the curve are obtained by experiments. Curve A represents the results of the second embodiment of the invention. Curve B represents the results of the conventional centrifugal fan. For example, in the same air pressure condition of 10 mmH2O, the amount of airflow produced by the conventional centrifugal fan is found to be 0.4 m3/mm, and the airflow volume of the second embodiment is 0.45 m3/mm, which is higher than that of the conventional fan. In addition, if provided with the same amount of airflow, the pressure in the fan frame according to the curve A is higher than the pressure of the conventional fan as shown by curve B. Thus, it is proved by FIG. 10 that the flow path with increasing size can eliminate the shortcomings of the conventional fan, increasing air pressure and amount of air airflow and minimizing turbulent flow. Hence, overall fan performance can be improved accordingly.

In other variations of the above embodiments, the beginning area, middle area, and ending area of the first or the second guide portion 13 or 17 can be either flat or sloped. When an area has a flat surface, the area is parallel to the bottom portion 12 or the top portion 16 of the frame 15. Thus, each guide portion 13 or 17 has a combination of flat and sloped surface.

Figure 11:
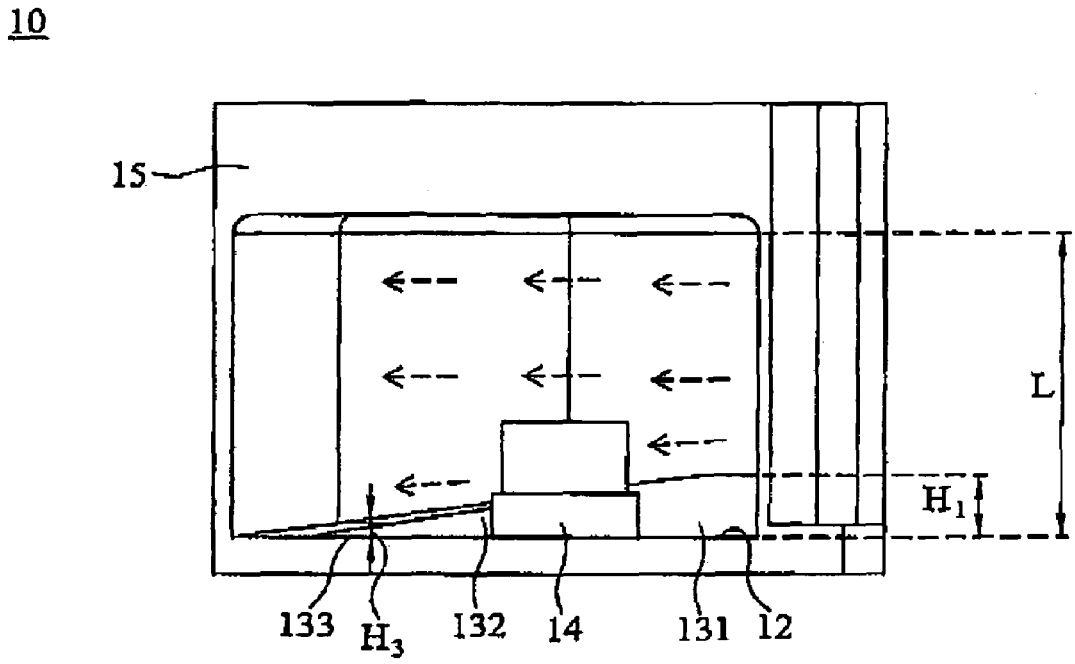
FIG. 11 is a side view of the centrifugal fan frame according to a variation of the invention.

FIG. 11 shows one of the possible combinations. In this variation, the beginning area 131 of the bottom portion 12 has a flat surface. The middle area 132 and the ending area 133 are sloped. Note that no matter which area is fiat or sloped, the height H1 of the beginning area 131 must be greater than the height H3 of the ending area 133. Thus, the variation provides the same effect as the above embodiments.

Hence, the performance of the centrifugal fan is optimized and the amount of the airflow and air pressure of the fan is also maximized.

While the invention has been described by way of example and in terms of the preferred embodiments, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A centrifugal fan frame, comprising:

a frame having a top portion, a bottom portion and a curved wall connected thereto; and at least one first guide portion extending from the bottom portion inwardly along an axial direction of the frame to form a flow path, the guide portion comprising a beginning area, a middle area, and an ending area, wherein the middle area connects the beginning and the ending areas, the beginning area has a width less than that of the ending area, and the beginning area has a height greater than that of the ending area, and the top portion has a second guide portion disposed corresponding to the first guide portion.

2. The centrifugal fan frame as claimed in claim 1, wherein the beginning area has a height less than 30% of a distance measured from the bottom portion to the top portion.

3. The centrifugal fan frame as claimed in claim 1, wherein the curved wall further comprises an airflow inlet.

4. The centrifugal fan frame as claimed in claim 3, wherein the beginning area extends from the airflow inlet.

5. The centrifugal fan frame as claimed in claim 1, wherein the beginning area, the middle area, or the ending area comprises a sloped surface, respectively.

6. The centrifugal fan frame as claimed in claim 1, wherein the beginning area, the middle area, or the ending area comprises a flat surface parallel to the bottom portion.

7. The centrifugal fan frame as claimed in claim 1, wherein the bottom portion and the first guide portion are integrally formed.

8. The centrifugal fan frame as claimed in claim 1, wherein a distance between the first guide portion and the second guide portion is at least 70% of a distance from the bottom portion to the top portion.

9. The centrifugal fan frame as claimed in claim 1, wherein the first guide portion and the second guide portion are symmetrically formed with respect to a plane.

10. The centrifugal fan frame as claimed in claim 1, wherein the top portion and the second guide portion are integrally formed.

* * * * *